US008651605B2

(12) United States Patent
Ito

(10) Patent No.: US 8,651,605 B2
(45) Date of Patent: Feb. 18, 2014

(54) IMAGE RECORDING APPARATUS

(75) Inventor: Koji Ito, Gufu (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 273 days.

(21) Appl. No.: 13/075,167

(22) Filed: Mar. 29, 2011

(65) Prior Publication Data

US 2011/0285769 A1 Nov. 24, 2011

(30) Foreign Application Priority Data

Mar. 29, 2010 (JP) ..... 2010-074461

(51) Int. Cl.
*B41J 29/38* (2006.01)
*B41J 2/01* (2006.01)

(52) U.S. Cl.
USPC ..... 347/9; 347/5; 347/16; 347/101; 347/104

(58) Field of Classification Search
USPC ..... 347/5, 9, 14, 16, 98
See application file for complete search history.

(56) References Cited

U.S. PATENT DOCUMENTS

| | | | | |
|---|---|---|---|---|
| 5,531,436 | A * | 7/1996 | Ohyama et al. | 271/275 |
| 5,821,968 | A * | 10/1998 | Ohyama et al. | 347/104 |
| 7,195,349 | B2 | 3/2007 | Uji et al. | |
| 7,506,974 | B2 * | 3/2009 | Hirakawa | 347/101 |
| 8,256,891 | B2 * | 9/2012 | Kato | 347/104 |
| 8,287,120 | B2 * | 10/2012 | Murata et al. | 347/104 |
| 8,303,105 | B2 * | 11/2012 | Kato | 347/104 |
| 2006/0238592 | A1 | 10/2006 | Kadomatsu et al. | |
| 2008/0239054 | A1 | 10/2008 | Koike | |

FOREIGN PATENT DOCUMENTS

| | | | |
|---|---|---|---|
| CN | 1705602 | A | 12/2005 |
| JP | 2002-284383 | A | 10/2002 |
| JP | 2005-199691 | A | 7/2005 |
| JP | 2006-043915 | A | 2/2006 |
| JP | 2006-219235 | A | 8/2006 |
| JP | 2006-290494 | A | 10/2006 |
| JP | 2007-101584 | A | 4/2007 |
| JP | 2008-027175 | A | 2/2008 |
| JP | 2008065025 | A * | 3/2008 |
| JP | 2008-273175 | A | 11/2008 |
| WO | 2005/026029 | A1 | 3/2005 |

OTHER PUBLICATIONS

European Patent Office, extended European Search Report for European Patent Application No. 11160188.6 (counterpart to above-captioned patent application), dated May 31, 2011.
Japan Patent Office, Notification of Reason for Refusal for Japanese Patent Application No. 2010-074461 (counterpart to above-captioned patent application), dispatched May 15, 2012.

(Continued)

*Primary Examiner* — Laura Martin
*Assistant Examiner* — Jeremy Bishop
(74) *Attorney, Agent, or Firm* — Baker Botts L.L.P.

(57) ABSTRACT

An image recording apparatus includes: an image recording portion; a treatment-liquid ejecting portion; a conveying mechanism having a support face; an adsorption mechanism including first and second electrodes arranged so as to be spaced from each other and so as to face a recording medium supported on the support face with the support face interposed between the recording medium and the first and second electrodes; and a controller which controls the treatment-liquid ejecting portion to eject treatment liquid onto at least a part of a first area of the recording medium before the image recording. The first area is an area near a leading end of the recording medium, and wherein the first area is overlaid, as seen in a direction perpendicular to the support face, on an area interposed between the first and second electrodes.

12 Claims, 9 Drawing Sheets

(56) References Cited

OTHER PUBLICATIONS

The State Intellectual Property Office of the People's Republic of China, Notification of First Office Action for Chinese Patent Application No. 201110062301.3 (counterpart Chinese patent application), issued Feb. 22, 2013.

Japan Patent Office, Notification of Reason for Refusal for Japanese Patent Application No. 2010-074461 (counterpart to above-captioned patent application), dispatched Feb. 21, 2012.

* cited by examiner

IMAGE RECORDING APPARATUS

CROSS REFERENCE TO RELATED APPLICATION

The present application claims priority from Japanese Patent Application No. 2010-074461, which was filed on Mar. 29, 2010, the disclosure of which is herein incorporated by reference in its entirety.

BACKGROUND OF THE INVENTION

1. Field of the Invention

The present invention relates to an image recording apparatus configured to convey a recording medium using an electrostatically adsorption force to perform recording.

2. Description of the Related Art

There is known an image recording apparatus of an ink-jet type, a laser type, or the like, configured to perform recording on a recording medium, such as a sheet, by conveying the recording medium in a conveying direction while electrostatically adsorbing the recording medium on a support face of a convey belt.

SUMMARY OF THE INVENTION

In a case of relatively low environmental humidity, a medium conveying failure may occur in such an image recording apparatus. Examples of the medium convey failure include a float of a leading end portion of the recording medium (a downstream end portion thereof in the conveying direction), a paper jam caused by the float, and the like. That is, an adsorption force of the recording medium generated by an effect called "Johnsen-Rahbeck effect" is susceptible to an electric resistance value of the recording medium. Thus, where an electric resistance value of an inside of the recording medium is increased by drying of the recording medium due to relatively low environmental humidity, the adsorption force of the recording medium becomes relatively small in comparison with a case at ordinary temperature and humidity. Thus, where the apparatus is designed such that the adsorption force takes an optimal value at ordinary temperature and humidity, the leading end portion of the recording medium is more likely to float. In contrast, where the apparatus is designed so as to obtain enough adsorption force even at relatively low environmental humidity, an excessive amount of the adsorption force is generated at ordinary temperature or at high humidity, leading to excessive friction between the convey belt and a platen. In addition, this case requires a high voltage to be supplied in order for the recording medium to be electrostatically conveyed, which leads to a disadvantage in cost. Since a technique of the conventional image recording apparatus cannot solve these problems, it is difficult for the image recording apparatus to stably convey the recording medium in the case where the environmental humidity is relatively low.

This invention has been developed in view of the above-described situations, and it is an object of the present invention to provide an image recording apparatus capable of stably conveying a recording medium using an electrostatic adsorption force even in a case of relatively low environmental humidity.

The object indicated above may be achieved according to the present invention which provides an image recording apparatus comprising: an image recording portion configured to eject recording liquid onto a recording medium to record an image on the recording medium; a treatment-liquid ejecting portion configured to eject treatment liquid onto the recording medium, wherein the treatment liquid is liquid different from the recording liquid and having a property for lowering an electric resistance value of the recording medium; a conveying mechanism having a support face for supporting the recording medium and configured to convey the recording medium in a conveying direction while supporting the recording medium on the support face; an adsorption mechanism including a first electrode and a second electrode which are arranged so as to be spaced from each other on a plane parallel to the support face and so as to face the recording medium supported on the support face with the support face interposed between the recording medium and the first and second electrodes, the adsorption mechanism being configured to electrostatically adsorb the recording medium to the support face where different electric potential are applied respectively to the first electrode and the second electrode; and a controller configured to control the treatment-liquid ejecting portion such that the treatment liquid is ejected onto at least a part of a first area of the recording medium before the image recording portion records the image on the recording medium, wherein the first area is an area near a leading end of the recording medium, and wherein the first area is overlaid, as seen in a direction perpendicular to the support face, on an area interposed between the first electrode and the second electrode on the plane parallel to the support face.

BRIEF DESCRIPTION OF THE DRAWINGS

The objects, features, advantages, and technical and industrial significance of the present invention will be better understood by reading the following detailed description of embodiments of the invention, when considered in connection with the accompanying drawings, in which.

DETAILED DESCRIPTION OF THE EMBODIMENTS

Hereinafter, there will be described embodiments of the present invention by reference to the drawings.

Figure 1:
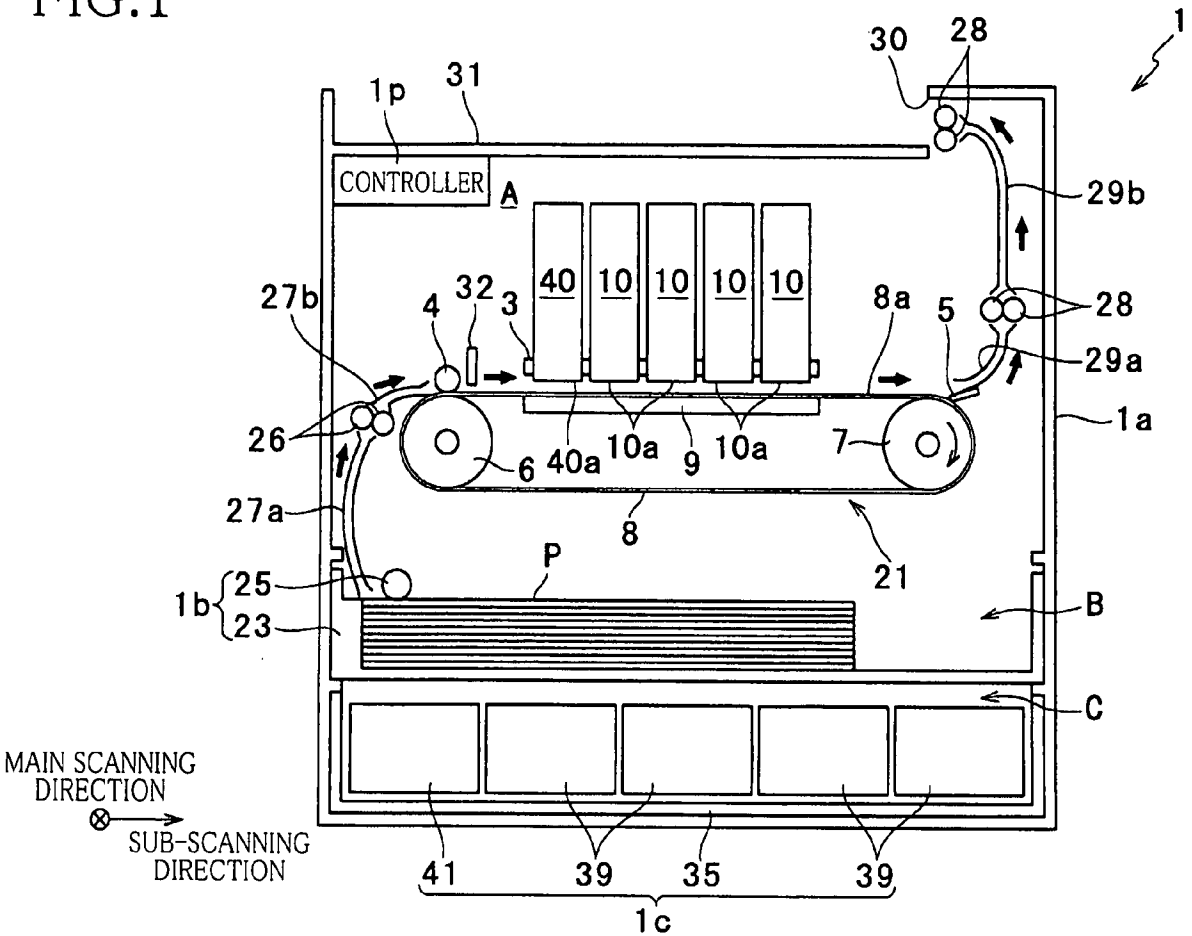
FIG. 1 is a side view generally showing an internal structure of an ink-jet printer as a first embodiment of the present invention.

First, there will be explained an overall construction of an ink-jet printer 1 as a first embodiment of the present invention with reference to FIG. 1.

The printer 1 includes a casing 1*a* having a rectangular parallelepiped shape. A sheet-discharge portion 31 is provided at an upper portion of a top plate of the casing 1*a*. An inner space of the casing 1*a* is divided into spaces A, B, and C in order from an upper side thereof. In the spaces A, B is formed a sheet conveying path which is continuous to the sheet-discharge portion 31. In the space C, a cartridge 41 and four ink-jet cartridges 39 are accommodated. The cartridge 41 can store treatment liquid (agent) such as pretreatment liquid to be supplied to a precoat head 40 as one example of a treatment-liquid ejecting portion, that is, the cartridge 41 functions as a treatment-liquid supply source for the precoat head 40. Each of the four cartridges 39 can store an ink to be supplied to a corresponding one of four ink-jet heads 10 as one example of an image recording portion, that is, each cartridge 39 functions as an ink supply source for the corresponding ink-jet head 10.

In the space A, there are arranged the precoat head 40, the four heads 10, a conveying mechanism such as a sheet-convey unit 21 for conveying or feeding a recording medium such as a sheet P, a guide unit for guiding the sheet P, and so on. In an upper portion of the space A, there is disposed a controller 1*p* configured to control operations of components of the printer 1 to control an overall operation of the printer 1.

The controller 1*p* controls a recording operation on the basis of image data supplied or transmitted from an external device. Examples of the recording operation include a conveying operation for conveying the sheet P, an ejecting operation for ejecting the ink or the pretreatment liquid in synchronization with the conveying operation, and so on. The control of the recording operation will be explained in detail later.

The sheet-convey unit 21 includes: (a) belt rollers 6, 7; (b) an endless sheet-convey belt 8 wound around the rollers 6, 7; (c) a nip roller 4 and a peeling plate 5 disposed outside the sheet-convey belt 8; (d) a platen 9 disposed inside the sheet-convey belt 8; and so on. The belt roller 7 is a drive roller which is rotated in a clockwise direction in FIG. 1 by a drive power of a sheet-convey motor 121 (see FIG. 6). The rotation of the belt roller 7 rotates or circulates the sheet-convey belt 8 in a direction indicated by bold arrow in FIG. 1. The belt roller 6 is a driven roller which is rotated in the clockwise direction in FIG. 1 in accordance with the rotation of the sheet-convey belt 8. The nip roller 4 is disposed so as to face the belt roller 6. When the sheet P is supplied from an upstream side of the nip roller 4 in a conveying direction in which the sheet P is conveyed, the nip roller 4 presses the sheet P onto a support face 8*a* as an outer circumferential face of the sheet-convey belt 8. The sheet P is then fed toward the belt roller 7 with the rotation of the sheet-convey belt 8 while supported on the support face 8*a*. The peeling plate 5 is disposed so as to be opposed to the belt roller 7. The peeling plate 5 peels the sheet P from the support face 8*a* to guide the peeled sheet P toward a downstream side in the conveying direction.

The platen 9 is disposed so as to face the precoat head 40 and the four heads 10 and supports an inner circumferential face of an upper portion of the sheet-convey belt 8. The platen 9 has an upper face which is parallel to the support face 8*a* and to which an adsorption mechanism such as an adsorption (attraction) electrode 50 (see FIG. 5) is fixed. Where an electric potential is applied to the adsorption electrode 50 by a high-voltage power supply 59 (see FIG. 6), the electrode 50 generates an electrostatic adsorption (attraction) force for electrostatically adsorbing or attracting the sheet P to the support face 8*a*. The high-voltage power supply 59 applies, to the adsorption electrode 50, a high-voltage electric potential required for the adsorption. It is noted that a specific construction of the adsorption electrode 50 and the electrostatic adsorption by the adsorption electrode 50 will be explained later.

Each of the heads 10, 40 is a line head having a generally rectangular parallelepiped shape elongated in a main scanning direction in which each head reciprocates. Each head 10, 40 has a lower face functioning as an ejection face 10*a* or 40*a* in which a multiplicity of ejection openings (see ejection openings 14*a* of the head 10 shown in FIGS. 3 and 4, for example) are formed. When image recording (image forming) is performed, each head 10 ejects an ink of a corresponding one of four colors, namely, black, magenta, cyan, and yellow, from the corresponding ejection face 10*a*. Further, as will be explained below, the precoat head 40, according to circumstances, ejects the pretreatment liquid from the ejection face 40*a* onto the sheet P on which no ink has been landed or attached. The heads 10, 40 are supported by the casing 1*a* via a head holder 3 so as to be arranged at predetermined pitches in a sub-scanning direction which is perpendicular to the main scanning direction. The head holder 3 holds the heads 10, 40 such that the ejection faces 10*a*, 40*a* face the support face 8*a* of the upper portion of the sheet-convey belt 8 so as to provide a specific space suitable for the recording between the support face 8*a* and the ejection faces 10*a*, 40*a*. A specific construction of each head 10, 40 will be explained in greater detail later.

The guide unit includes an upstream guide portion and a downstream guide portion arranged respectively on opposite sides of the sheet-convey unit 21. The upstream guide portion includes two guides 27*a*, 27*b* and a pair of sheet-convey rollers 26 and connects between the sheet-convey unit 21 and a sheet-supply unit 1*b* which will be described below. The downstream guide portion includes two guides 29; 29*b* and two pairs of sheet-convey rollers 28 and connects between the sheet-convey unit 21 and the sheet-discharge portion 31.

In the space B, the sheet-supply unit 1*b* is disposed so as to be attachable to and detachable from the casing 1*a*. The sheet-supply unit 1*b* includes a sheet-supply tray 23 and a sheet-supply roller 25. The sheet-supply tray 23 has a box-like shape opening upward and accommodates a plurality of sheets P of various sizes. The sheet-supply roller 25 supplies, to the upstream guide portion, an uppermost one of the sheets P accommodated in the sheet-supply tray 23.

As described above, in the spaces A, B is formed the sheet conveying path extending from the sheet-supply unit 1*b* to the sheet-discharge portion 31 via the sheet-convey unit 21. The controller 1*p*, on the basis of a recording command received from the external device, drives a plurality of motors such as a sheet-supply motor 125 for the sheet-supply roller 25 (see FIG. 6), a sheet-convey motor 127 for the sheet-convey rollers of each guide portion (see FIG. 6), the sheet-convey motor 121 (see FIG. 6), and the like. The sheet P supplied from the sheet-supply tray 23 is fed or conveyed to the sheet-convey unit 21 by the sheet-convey rollers 26. When the sheet P passes through a position just under the heads 10, 40, the heads 10 eject the inks of the respective four colors in order, to form a color image on the sheet P (noted that the precoat head 40 ejects the pretreatment liquid prior to the ejection of the inks according to circumstances). The ejecting operation of the ink and the pretreatment liquid is performed on the basis of a detection signal outputted from a sheet sensor 32. The sheet P is then peeled by the peeling plate 5 and conveyed upward by the sheet-convey rollers 28. The sheet P is then discharged onto the sheet-discharge portion 31 through an opening 30.

Here, the sub-scanning direction is a direction parallel to the conveying direction in which the sheet P is conveyed by the sheet-convey unit 21, and the main scanning direction is a direction parallel to a horizontal plane and perpendicular to the sub-scanning direction.

In the space C, a cartridge unit 1*c* is disposed so as to be attachable to and detachable from the casing 1*a*. The cartridge unit 1*c* includes a tray 35 and the five cartridges 41, 39 accommodated in the tray 35 so as to be arranged in a row.

Each of the cartridges 39 stores the ink of the corresponding color, and the cartridge 41 stores the pretreatment liquid. Each cartridge 39, 41 supplies the ink or the pretreatment liquid to the corresponding head 40 or 10 via a tube, not shown.

Figure 2:
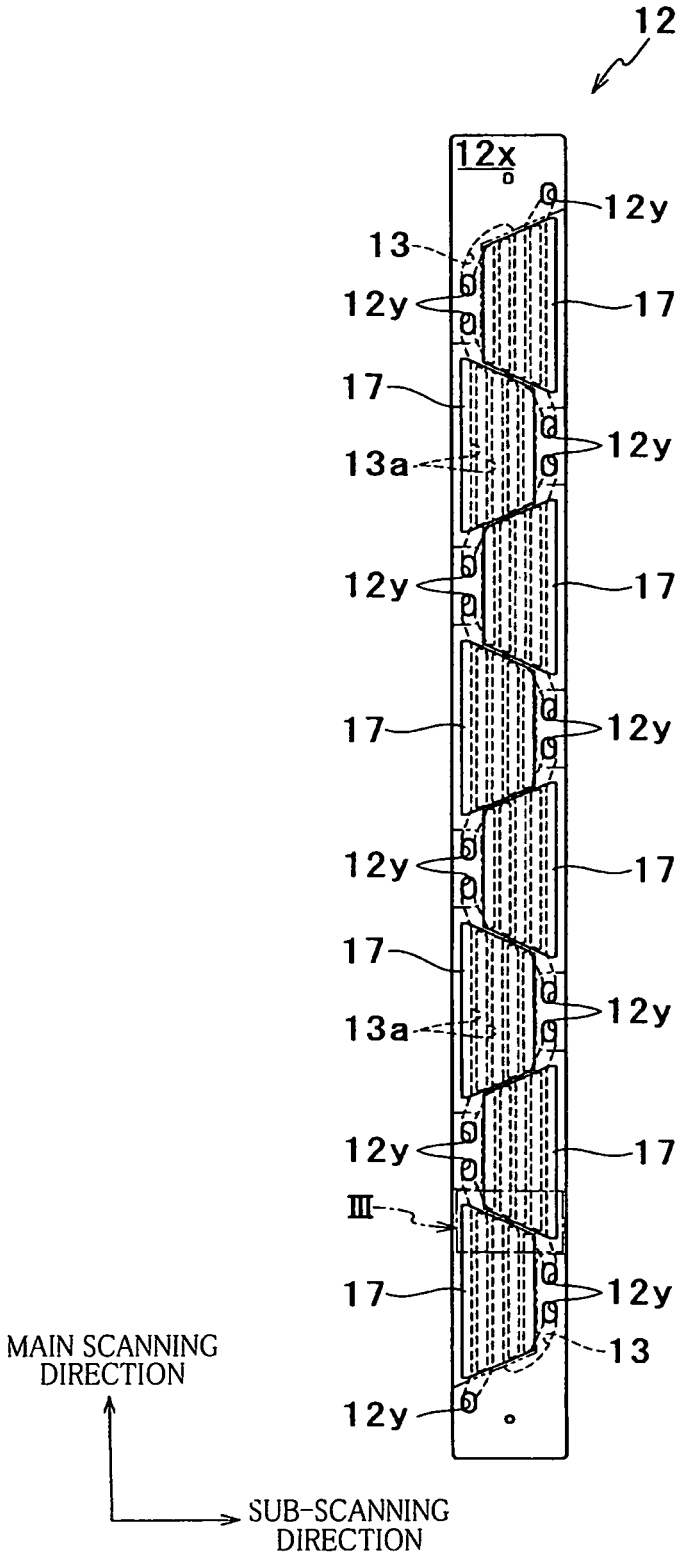
FIG. 2 is a plan view showing a channel unit and actuator units of an ink-jet head included in the printer.
Figure 3:
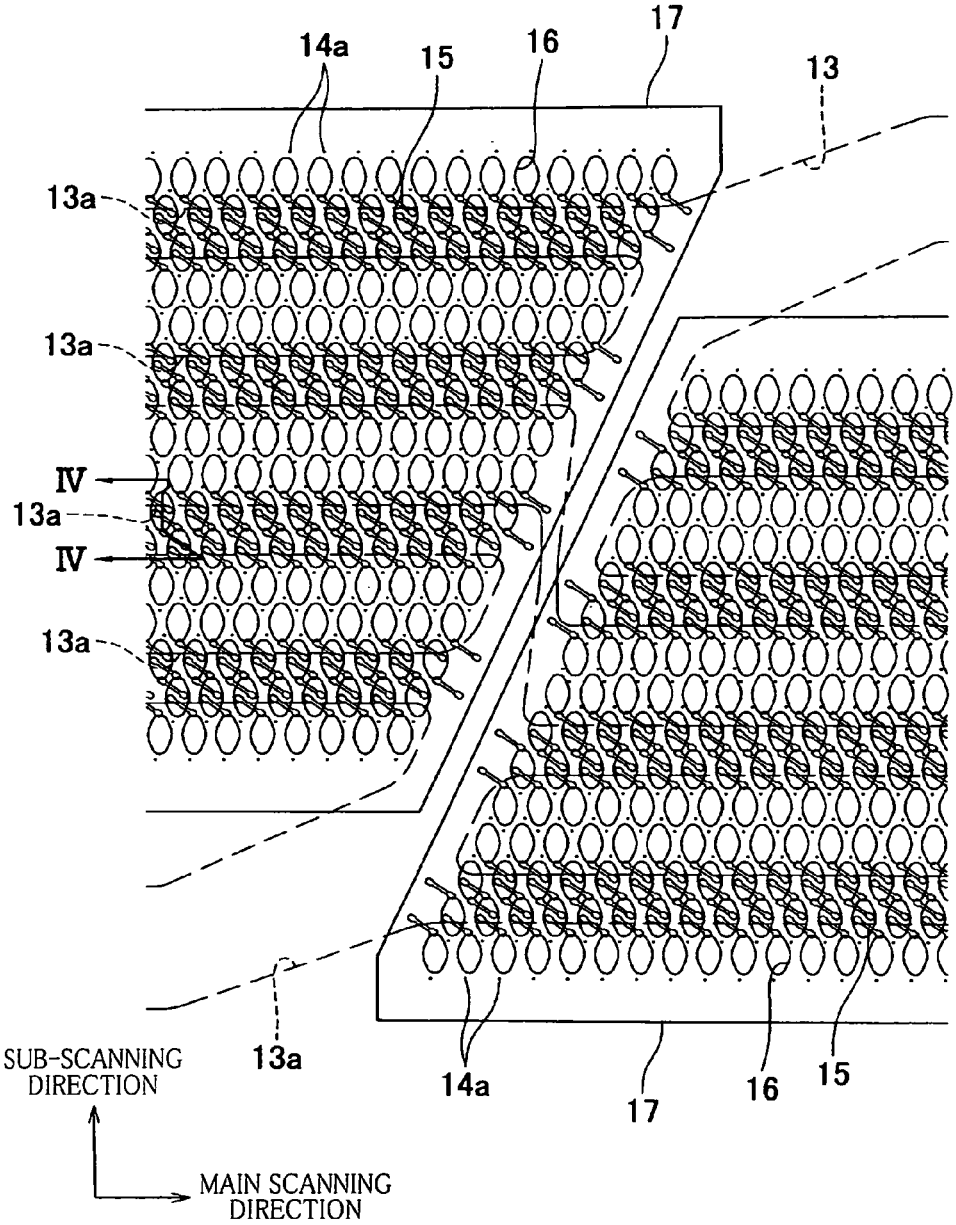
FIG. 3 is an enlarged view of an area III enclosed with one-dot chain line in FIG. 2.
Figure 4:
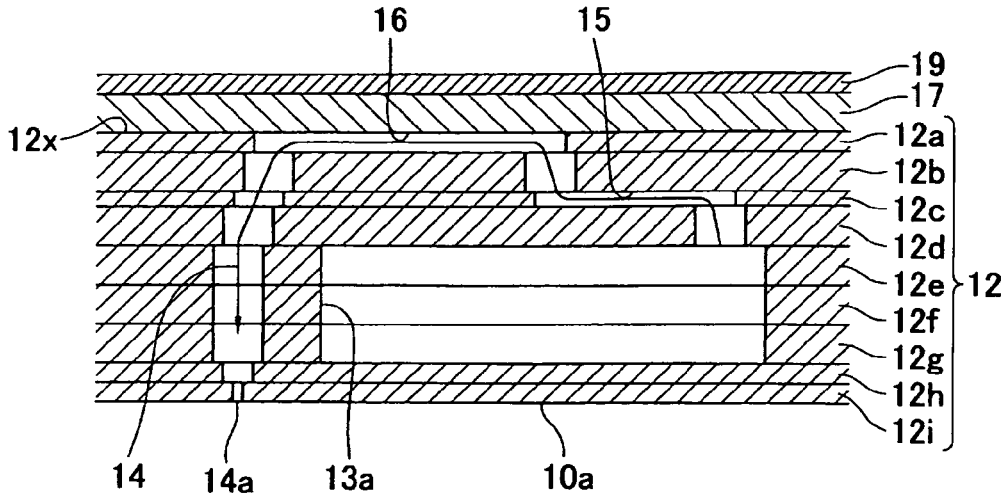
FIG. 4 is a cross-sectional view taken along IV-IV in FIG. 3.

There will be next explained the construction of the heads 10, 40 with reference to FIGS. 2-4. Since the heads 10, 40 have the same construction, the following explanation will be given for one of the heads 10 for the sake of simplicity. It is noted that, in FIG. 3, pressure chambers 16 and apertures 15 are indicated by solid lines for easier understanding purposes though these elements should be indicated by broken lines because the pressure chambers 16 and the apertures 15 are located under actuator units 17.

The head 10 includes: a reservoir unit, not shown, and a channel unit 12 which are stacked on each other in a vertical direction; the eight actuator units 17 (see FIG. 2) fixed to an upper face 12*x* of the channel unit 12; a flexible printed circuit (FPC) 19 (see FIG. 4) bonded to the actuator units 17; and so on. The reservoir unit has a channel formed therein which includes a reservoir for temporarily storing the ink supplied from the cartridge 39 (see FIG. 1). The channel unit 12 has channels formed therein each of which extends from a corresponding one of openings 12*y* (see FIG. 2) formed in the upper face 12*x* to a corresponding one of the ejection openings 14*a* formed in the lower face (the ejection face 10*a*). Each actuator unit 17 has piezoelectric actuators each for a corresponding one of the ejection openings 14*a*.

The reservoir unit has projecting portions and recessed, portions formed on and in a lower face of the reservoir unit. The projecting portions are respectively bonded to areas of the upper face 12*x* of the channel unit 12, on which areas no actuator units 17 are disposed (i.e., areas enclosed with two-dot chain lines in FIG. 2, including the openings 12*y*). A distal end face of each of the projecting portions has an opening connected to the reservoir and facing a corresponding one of the openings 12*y* of the channel unit 12. As a result, the reservoir and individual channels 14 are communicated with each other via the openings. The recessed portions face the upper face 12*x* of the channel unit 12, faces of the respective actuator units 17, and a face of the FPC 19 with a small space therebetween.

The channel unit 12 is constituted by nine metal plates 12*a*, 12*b*, 12*c*, 12*d*, 12*e*, 12*f*, 12*g*, 12*h*, 12*i* (see FIG. 4) having generally the same size and stacked and bonded on one another. As shown in FIGS. 2, 3, and 4, channels of the channel unit 12 include: manifold channels 13 each having one of the openings 12*y* at one end thereof; sub-manifold channels 13*a* each branched from a corresponding one of the manifold channels 13; and the individual channels 14 each extending from an outlet of a corresponding one of the sub-manifold channels 13*a* to a corresponding one of the ejection openings 14*a* via a corresponding one of the pressure chambers 16. As shown in FIG. 4, each of the individual channels 14 is formed for one of the ejection openings 14*a* and includes a corresponding one of the apertures 15 each functioning as a restrictor for adjusting a channel resistance. Generally rhombus openings each for exposing a corresponding one of the pressure chambers 16 are arranged in matrix in the area of the upper face 12*x* on which each actuator unit 17 is bonded. Likewise, the ejection openings 14*a* are arranged in matrix in a similar pattern in each area of the lower face (i.e., the ejection face 10*a*), which area is opposed to a corresponding one of the areas of the upper face 12*x* on which the respective actuator units 17 are bonded.

As shown in FIG. 2, the actuator units 17 each having a trapezoid shape in plan view are arranged in two arrays in a staggered fashion on the upper face 12*x* of the channel unit 12. As shown in FIG. 3, each actuator unit 17 covers openings of a multiplicity of the pressure chambers 16 which are formed in the bonded area of the actuator unit 17. Though not shown in any figures, each actuator unit 17 includes: a plurality of piezoelectric layers expanding so as to straddle or expand across the pressure chambers 16; and electrodes sandwiching the piezoelectric layers in a thickness direction thereof. The electrodes include: individual electrodes provided for the respective pressure chambers 16; and a common electrode for the pressure chambers 16. The individual electrodes are formed on a face of an uppermost one of the piezoelectric layers.

The FPC 19 has wirings respectively corresponding to the electrodes of the actuator unit 17, and a driver IC, not shown, is mounted on a midway portion of each wiring. The FPC 19 is fixed at one end thereof to the actuator unit 17 and at the other end to a control board of the head 10, not shown, which is disposed above the reservoir unit. Under the control of the controller 1*p* (see FIG. 1), the FPC 19 transmits various drive signals outputted from the control board, to the driver IC, and transmits signals produced by the driver IC to the actuator units 17.

It is noted that, in the precoat head 40, the pretreatment liquid is supplied from the cartridge 41 (see FIG. 1) to the reservoir of the reservoir unit.

The pretreatment liquid is liquid having a property for lowering an electric resistance value of the sheet P. Examples of the predetermined liquid include: liquid containing a cationic high polymer such as polyalamine; liquid containing a polyvalent metal salt such as magnesium salt; and the like. Further, the pretreatment liquid is preferably colorless and transparent from the viewpoint of ensuring a recording quality.

Figure 5:
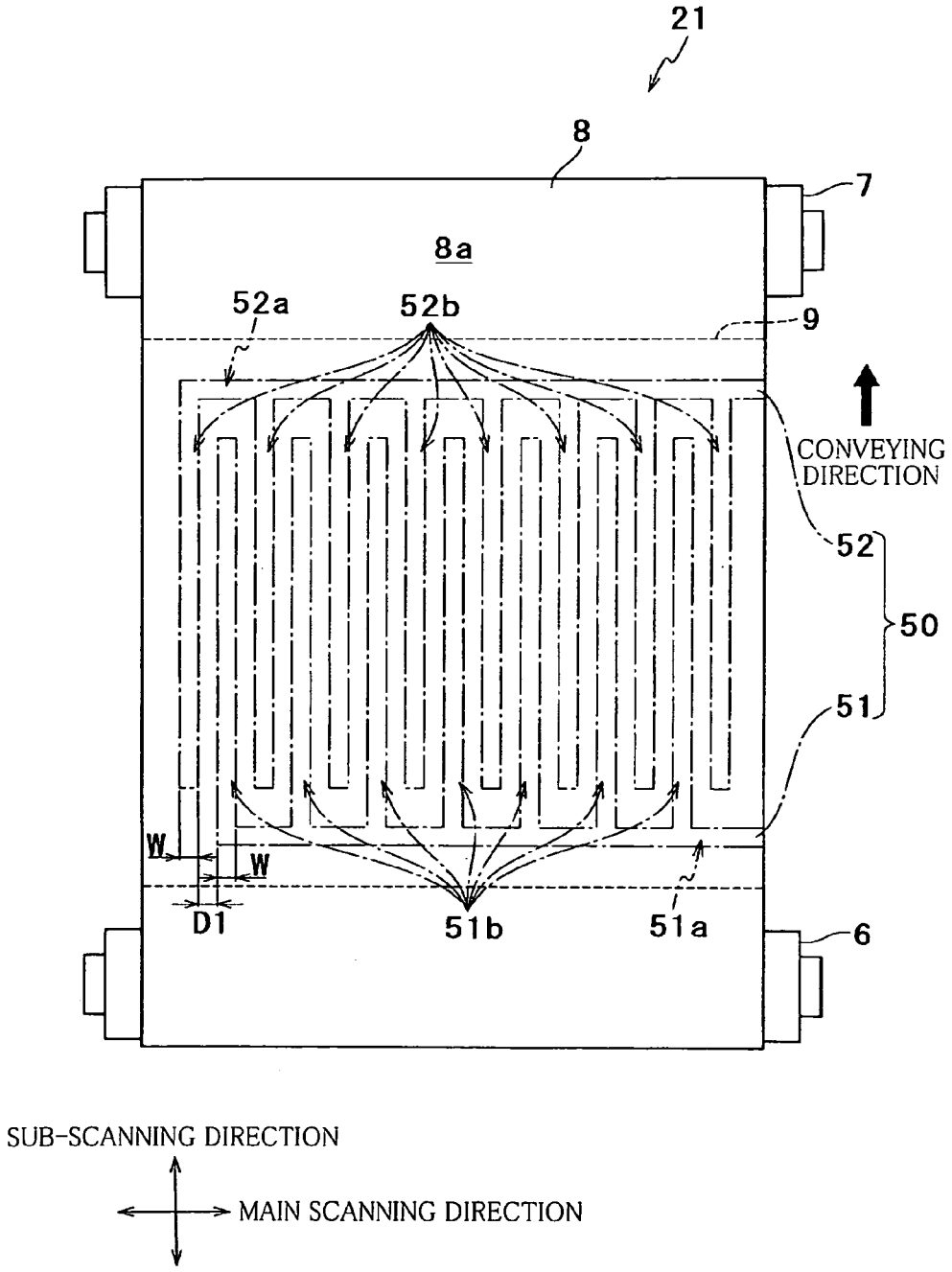
FIG. 5 is a plan view of a sheet-convey unit of the printer.

There will be next explained the specific construction of the adsorption electrode 50 and the electrostatic adsorption by the adsorption electrode 50 with reference to FIG. 5.

The adsorption electrode 50 is fixed to the upper face of the platen 9 so as to be located between the upper face and the inner circumferential face of the sheet-convey belt 8. The adsorption electrode 50 faces the sheet P being fed while supported by the support face 8*a*, with the support face 8*a* interposed between the adsorption electrode 50 and the sheet P.

The adsorption electrode 50 includes a pair of comb-like electrodes 51, 52 having the same construction. Each of the comb-like electrodes 51, 52 is formed of a metal electrode plate and includes: base portions 51*a*, 52*a* extending in the main scanning direction; and a multiplicity of projecting portions 51*b*, 52*b*. The projecting portions 51*b* extend from the base portion 51*a*, and the projecting portions 52*b* extend from the base portion 51*b*. The base portion 51*a* is disposed on an upstream side in the conveying direction, and the base portion 52*a* is disposed on a downstream side in the conveying direction. That is, the base portion 51*a* is disposed on an upstream side of the base portion 52*a* in the conveying direction. The projecting portions 51*b* extend from the base portion 51*a* toward a downstream side thereof in the conveying direction, and the projecting portions 52*b* extend from the base portion 52*a* toward an upstream side thereof in the conveying direction. That is, the projecting portions 51*b*, 52*b* respectively extend in opposite directions. The projecting portions 51*b* are arranged so as to be evenly spaced in the main scanning direction in order from the projecting portion 51*b* extending from a distal end (a left end in FIG. 5) of the base portion 51*a*. Likewise, the projecting portions 52*b* are arranged so as to be evenly spaced in the main scanning direction in order from the projecting portion 52*b* extending from a distal end (a left end in FIG. 5) of the base portion 52*a*. The projecting portions 51*b*, 52*b* are alternately arranged one by one in the main scanning direction so as to be spaced from one another in the main scanning direction that is a direction perpendicular to the conveying direction.

Widths W of the respective projecting portions 51*b*, 52*b* are the same among all the projecting portions 51*b*, 52*b*. In the present embodiment, each projecting portion 51*b*, 52*b* has the width W of 5 mm. Further, distances D1 each between one projecting portion 51*b* and a projecting portion 52*b* adjacent thereto are the same among all the projecting portions 51*b*, 52*b*. In the present embodiment, the distance D1 is 5 mm.

Under the control of the controller 1*p*, a potential difference is generated between each two of the projecting portions 51*b*, 52*b* by the high-voltage power supply 59 (see FIG. 6) applying a negative and a positive electric potential respectively to the comb-like electrodes 51, 52. As a result, there is formed an electric circuit in which a current flows through the following components or areas in order: a clearance between (a) one of two projecting portions 51*b*, 52*b* adjacent to each other, which one has a higher electric potential than the other and (b) the inner circumferential face of the sheet-convey belt 8; an inside of the sheet-convey belt 8; a clearance between the support face 8*a* of the sheet-convey belt 8 and the sheet P on the support face 8*a*; an inside of the sheet P; the clearance between the sheet P and the support face 8*a*; the inside of the sheet-convey belt 8; and a clearance between the inner circumferential face of the sheet-convey belt 8 and the other of the two projecting portions 51*b*, 52*b* adjacent to each other, which the other has a lower electric potential than the one. As a result, a kind of a condenser is formed in (a) the clearance between the support face 8*a* and the sheet P on the support face 8*a* and (b) the clearance between the projecting portions 51*b*, 52*b* and the inner circumferential face of the sheet-convey belt 8. A high electric field is generated by accumulation of the positive and negative electric charges respectively on the two faces constituting the condenser, thereby generating an adsorptive or attractive force called "Johnsen-Rahbeck force" which attracts the two faces to each other. This Johnsen-Rahbeck force (the electrostatic adsorption force) thus generated between the support face 8*a* and the sheet P causes the sheet P to be electrostatically adsorbed or attracted to the support face 8*a*.

Figure 6:
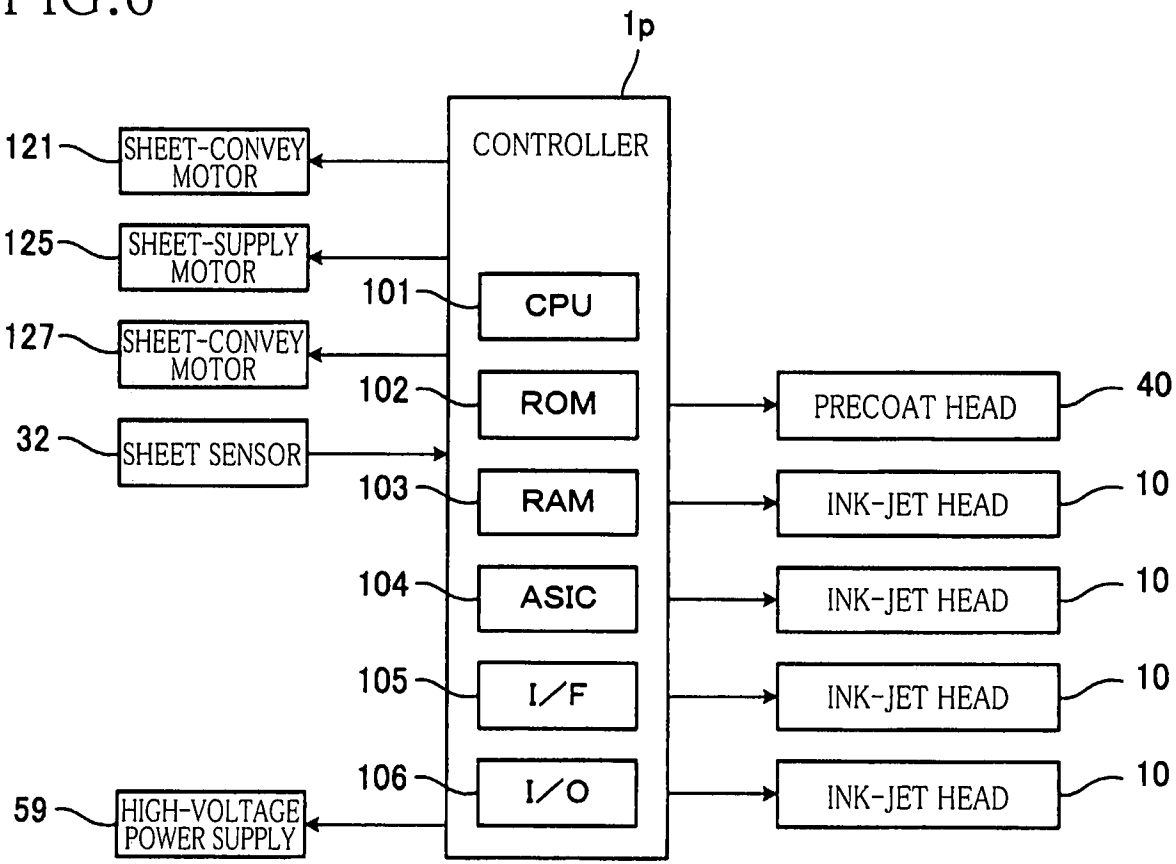
FIG. 6 is a block diagram showing an electric construction of the printer.

There will be next explained an electric construction of the printer 1 with reference to FIG. 6.

As shown in FIG. 6, the controller 1*p* includes a Central Processing Unit (CPU) 101, a Read Only Memory (ROM) 102, a Random Access Memory (RAM) 103 such as a non-volatile RAM, an Application Specific Integrated Circuit (ASIC) 104, an interface (I/F) 105, an Input/Output Port (I/O) 106, and so on. The ROM 102 stores therein programs executed by the CPU 101, various fixed data, and so on. The RAM 103 temporarily stores therein data required for the execution of the programs. One example of the data required for the execution of the programs includes image data relating to an image to be formed on the sheet P. The ASIC 104 performs, e.g., rewriting and sorting of the image data. Specifically, the ASIC 104 performs a signal processing and an image processing, for example. The I/F 105 transmits or receives data to or from the external device. The I/O 106 inputs or outputs detection signals of various sensors.

The controller 1*p* is connected to the motors 121, 125, 127, the sheet sensor 32, the control boards for the respective heads 10, 40, the high-voltage power supply 59 for the adsorption electrode 50, and so on.

Figure 7:
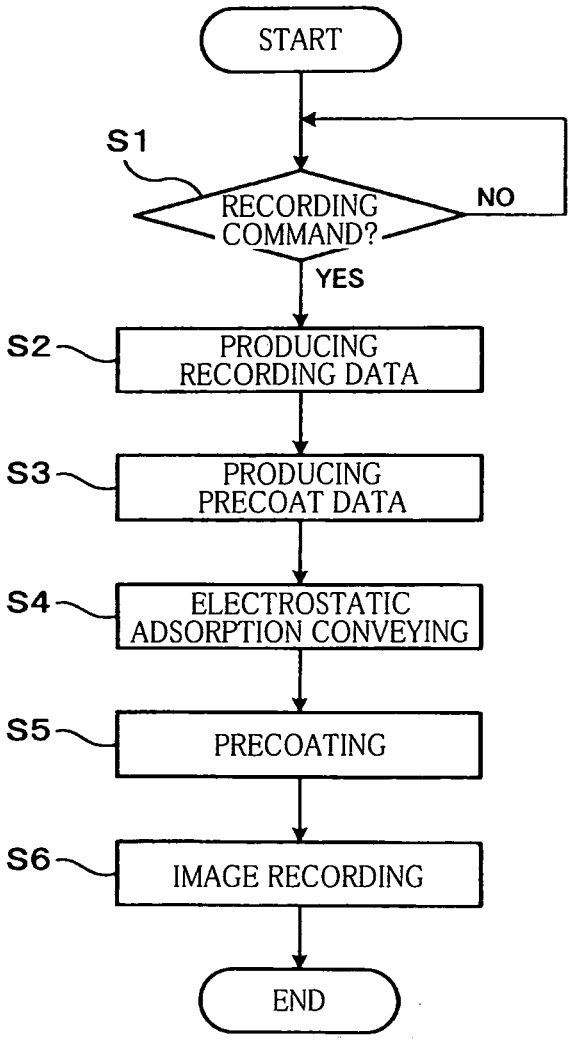
FIG. 7 is a flow-chart showing a control of a recording operation performed by a controller of the printer.

There will be next explained a recording processing of the recording operation controlled by the controller 1*p* with reference to FIG. 7. Processings explained below are executed by the CPU 101 in accordance with the programs stored in the ROM 102.

Initially in S1, when a power of the printer 1 has been turned on, the controller 1*p* checks whether the controller 1*p* has received the recording command from the external device or not. Where the controller 1*p* has judged that the controller 1*p* has not received the recording command from the external device (S1: NO), the controller 1*p* repeats the processing of S1.

Where the controller 1*p* has judged that the controller 1*p* has received the recording command (S1: YES), the controller 1*p* in 82 stores to the RAM 103 image data and so on transmitted with the recording command and then converts the image data in accordance with the arrangement of the ejection openings 14*a* of each the head 10, thereby producing recording data describing an ink ejection pattern based on which each head 10 ejects the ink onto the sheet P.

Figure 8:
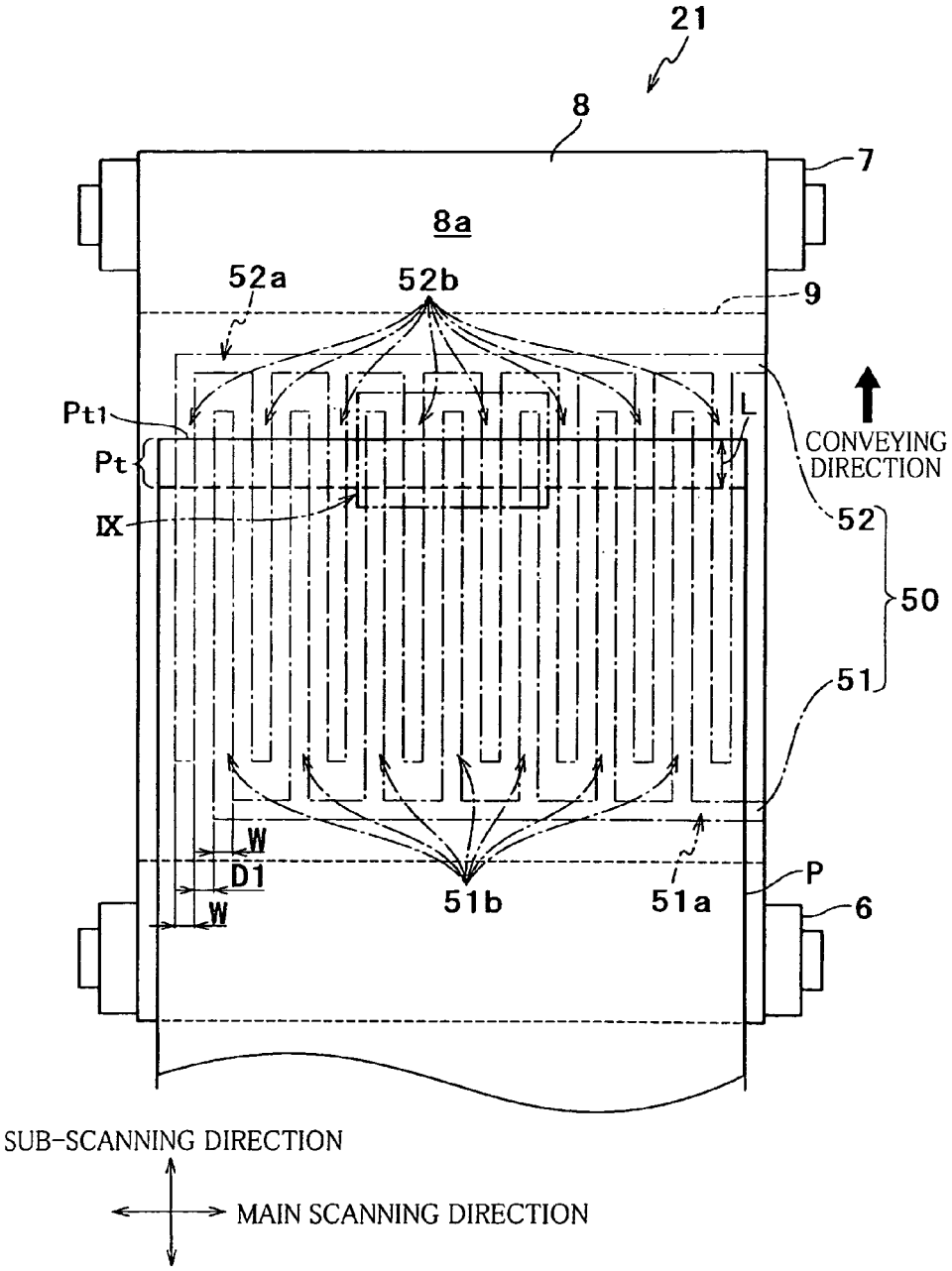
FIG. 8 is a view for explaining an application pattern of pretreatment liquid.
Figure 9:
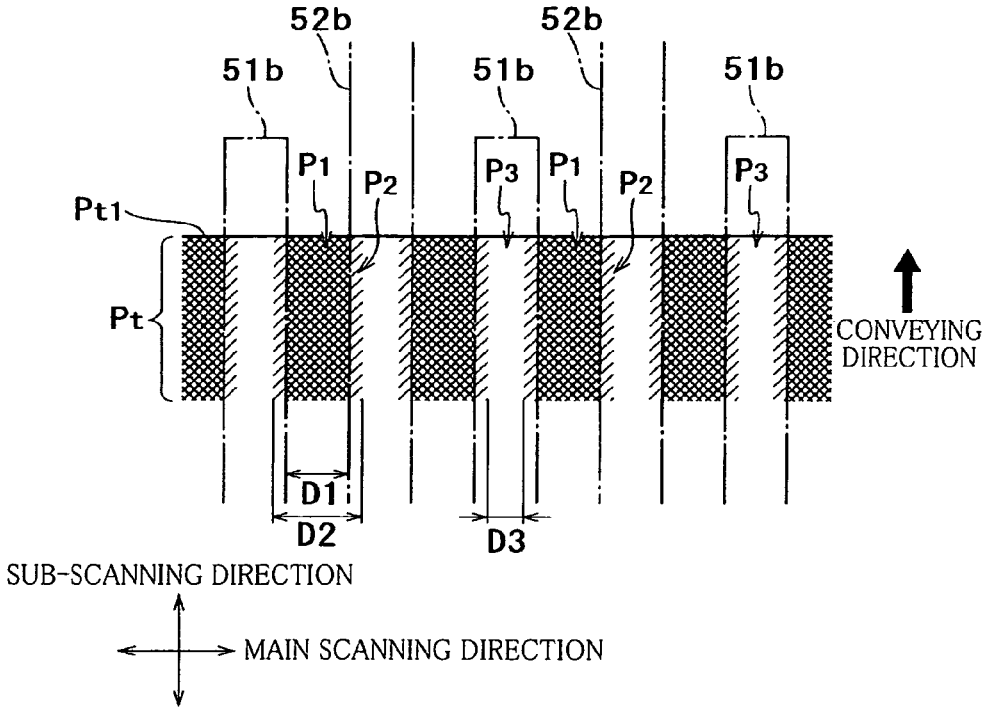
FIG. 9 is an enlarged view of an area IX enclosed with two-dot chain line in FIG. 8.

Then in S3, the controller 1*p* produces precoat data describing or indicating an ejection pattern based on which the precoat head 40 ejects the pretreatment liquid onto the sheet P. Here, there will be explained a production of the precoat data in S3 with reference to FIGS. 8 and 9. FIGS. 8 and 9 show a state in which the sheet P is conveyed while supported on the support face 8*a* of the sheet-convey belt 8.

In S3, the controller 1*p* produces the precoat data such that the pretreatment liquid is ejected onto or applied to second areas P2 (see FIG. 9) of a leading end portion Pt of the sheet P which is a downstream end portion of the sheet P in the conveying direction. The leading end portion Pt expands from a leading end Pt1 of the sheet P toward an upstream side thereof by a specific length L. Specifically, a distance in the conveying direction between the leading end N1 and an upstream end of the leading end portion Pt in the conveying direction is equal to or less than a specific value.

Each of the second areas P2 includes a corresponding one of first areas P1 of the leading end portion Pt of the sheet P. Each of the first areas P1 is an area which is overlaid, as seen in a direction perpendicular to the support face 8*a*, on an area between corresponding two of the projecting portions 51*b*, 52*b* that are adjacent to each other on the support face 8*a*. Each first area P1 is shaded in FIG. 9 and has a width the same as the distance D1 between the projecting portions 51*b*, 52*b*. Each second area P2 is an area which is overlaid, as seen in the direction perpendicular to the support face 8; on an area straddling or expanding across corresponding two of the projecting portions 51*b*, 52*b* that are adjacent to each other on the support face 8*a*. The second area P2 is constituted by areas diagonally shaded in FIG. 9 and the shaded first area P1, and has a width D2 larger than the distance D1 between the projecting portions 51*b*, 52*b*. For example, the width D2 is 7 mm, with 1 mm being on both sides of the distance D1 (5 mm). The second areas P2 are arranged in the main scanning direction so as to be spaced at clearances (distances) D3 (the clearance D3 is 3 mm in the main scanning direction where the distance D1 is 5 mm and the distance D2 is 7 mm). The clearance D3 is formed in a part of each of third areas P3 of the leading end portion Pt of the sheet P. Each third area P3 is an area which is overlaid, as seen in the direction perpendicular to the support face 8*a*, on one of the projecting portions 51*b*, 52*b* on the support face 8*a* in the leading end portion Pt of the sheet P. Each of the third areas P3 has a width of 5 min in the main scanning direction, which width is the same as that of each projecting portion 51*b*, 52*b*.

Here, the discussion returns to the explanation of FIG. 7. After S3, the controller 1*p* in S4 performs an electrostatic adsorption conveying in which the controller 1*p* controls the motors 121, 125, 127 so as to obtain a specific convey speed and controls the high-voltage power supply 59 so as to apply specific electric potentials respectively to the comb-like electrodes 51, 52 of the adsorption electrode 50. As a result, the sheet P supplied from the sheet-supply tray 23 is conveyed in the conveying direction while electrostatically adsorbed on the support face 8*a* of the sheet-convey belt 8.

Then in S5, the controller 1*p* performs precoating in which the controller 1*p* controls the actuator units 17 of the precoat head 40 such that the precoat head 40 ejects the pretreatment liquid on the basis of the precoat data produced in 83 in synchronization with the conveying operation for the sheet P. Then in 86, the controller 1*p* performs the image recording in which the controller 1*p* controls the actuator units 17 of each head 10 such that the head 10 ejects the ink on the basis of the recording data produced in S2 in synchronization with the conveying operation for the sheet P. The controller 1*p* finishes this recording processing after the precoating and the image recording have been performed on the sheet(s) P. The number of the sheets P on which the precoating and the image recording are performed is determined by an instruction of the recording command received in S1.

As described above, in this printer 1, the pretreatment liquid is applied in S5 to the sheet P in advance of the image recording, thereby lowering the electric resistance value of the sheet P. Then in the adsorption conveying, a current is passed through a part (at least a part of the first areas P1) of the sheet P whose electric resistance value has been lowered by the application of the pretreatment liquid, whereby the above-described Johnsen-Rahbeck force is generated well. As a result, even where an environmental humidity is relatively low, it is possible to prevent a lowering of the electrostatic adsorption force for the sheet P, thereby making it possible to stably convey the sheet P using the electrostatic adsorption force.

Further, where a voltage to be applied to the adsorption electrode 50 is set with respect to a case where the environmental humidity is relatively low (i.e., a case where the electrostatic adsorption force for the sheet P is small), an excessively high voltage is applied to the adsorption electrode 50, leading to (a) disadvantages in cost, safety, and the like and (b) increasing load to the sheet-convey unit 21. Further, the voltage to be applied to the adsorption electrode 50 can be changed with the environmental humidity, but in this case, there are disadvantages in cost and controls. However, in this printer 1, since the pretreatment liquid is applied in S5 to the sheet P in advance of the image recording, it is possible to lower the voltage to be applied to the adsorption electrode 50 and to obtain a stable electrostatic adsorption force, thereby reducing the above-described disadvantages.

Where the projecting portions 51*b*, 52*b* extend in a direction intersecting the conveying direction, electric field intensities applied to the sheet P are alternately changed in the conveying of the sheet P, causing the sheet P to be conveyed unstably. However, in this printer 1, since the projecting portions 51*b*, 52*b* extend in the conveying direction, it is possible to restrain the change of the electric field intensities applied to the sheet P being conveyed, making it possible to convey the sheet P more stably.

For example, where the adsorption electrode 50 is not fixed to a specific position in the printer 1, problems arise such as higher cost and complication of an electric supply mechanism for the adsorption electrode 50, as in a case where the adsorption electrode 50 is disposed in the sheet-convey belt 8. Further, where the adsorption electrode 50 is disposed in the sheet-convey belt 8, the adsorption electrode 50 is moved with the rotation of the sheet-convey belt 8, causing a problem of a durability of the adsorption electrode 50. However, in this printer 1, since the adsorption electrode 50 is fixed to a specific position (i.e., the platen 9) in the printer 1, it is possible to reduce these problems.

Further, since the adsorption electrode 50 is fixed to the platen 9, there is no need to provide a component for fixing the adsorption electrode 50. Thus, in this printer 1, it is possible to restrain complication of the construction and higher cost.

In S5, the controller 1*p* controls the precoat head 40 such that, as shown in FIG. 9, the pretreatment liquid is applied to the sheet P uniformly or evenly in a widthwise direction of the sheet P (i.e., in the main scanning direction). As a result, the electrostatic adsorption force is generated uniformly in the widthwise direction of the sheet P, thereby making it possible to convey the sheet P more stably.

In S5, the controller 1*p* controls the precoat head 40 such that the pretreatment liquid is applied to the second areas P2 shown in FIG. 9. As a result, when compared with a case where the pretreatment liquid is applied only to a part of the first areas P1, the electrostatic adsorption force for the sheet P is improved, thereby making it possible to convey the sheet P more stably.

Further, in this printer 1, since the pretreatment liquid is applied to the second areas P2 arranged so as to be spaced from one another with the clearances D3 each interposed between corresponding adjacent two of the second areas P2, it is possible to restrain problems caused by application of a large amount of the pretreatment liquid (e.g., higher cost associated with excessive use of the pretreatment liquid, deterioration of a quick dry property of the sheet P, a bend of the sheet P after the drying, and the like).

In S5, the controller 1*p* controls the precoat head 40 such that the pretreatment liquid is applied only to the leading end portion Pt of the sheet P shown in FIGS. 8 and 9. As a result, it is possible to restrain the above-described problems caused by the application of the large amount of the pretreatment liquid and to effectively prevent a sheet conveying failure such as a float of the leading end portion Pt and a paper jam caused by the float. Further, since no image is often recorded on the leading end portion Pt, it is possible to restrain an adverse effect of the pretreatment liquid on a recording quality.

It is noted that where the controller 1*p*, by referring the recording data produced in S2, has judged in S3 that the second areas P2 include image recording areas of the sheet P on each of which the ink is to be landed, the controller 1*p* preferably produces the precoat data such that the pretreatment liquid is applied to areas of the second areas P2 except the image recording areas (i.e., non-recording areas). Where the printer 1 is configured in this manner, the pretreatment liquid is ejected in S5 only onto the non-recording areas of the second areas P2, thereby making it possible to restrain the adverse effect of the pretreatment liquid on the recording quality.

Further, where the image recording is performed on both sides of the sheet P and after the image recording has been performed on one side of the sheet P, the electrostatic adsorption force tends to be lowered when the image recording is performed on the other side. This is for the following reason. That is, the one side on which the image recording has been performed has a relatively low electric resistance value due to relatively high humidity caused by the ink landed on the one side of the sheet P. Since the one side of the sheet P and the support face 8*a* of the sheet-convey belt 8 are adjacent to each other, a current flowing from the sheet-convey belt 8 into the sheet P is likely to flow only into an inside area of the sheet P near the one side thereof. Thus, an amount of the current flowing through the inside of the sheet P is decreased, causing a decrease in the adsorption force between the sheet-convey belt 8 and the sheet P. However, in this printer 1, since the pretreatment liquid is applied to the other side of the sheet P to lower an electric resistance value of an inside area of the sheet P near the other side thereof, the current having flowed from the sheet-convey belt 8 into the sheet P flows not only to the inside area near the one side but also to the area near the other side, which facilitates the current to flow through the inside are of the sheet P. That is, in this printer 1, it is possible to restrain that the Johnsen-Rahbeck force is decreased, thereby maintaining a desired amount of the adsorption force. Accordingly, also in the case of the two-side recording, it is possible to convey the sheet F stably using the electrostatic adsorption force.

There will be next explained an ink-jet printer as a second embodiment of the present invention.

The printer as the second embodiment is different from the printer 1 as the first embodiment only in the configuration of the adsorption electrode 50. In this second embodiment, the adsorption electrode 50 is disposed in the sheet-convey belt 8. In this second embodiment, it is possible to reduce wear and a sliding loss of the adsorption electrode 50 caused by friction between the adsorption electrode 50 and the sheet-convey belt 8, thereby improving the durability of the adsorption electrode 50.

There will be next explained an ink-jet printer as a third embodiment of the present invention.

The printer as the third embodiment is different from the printer 1 as the first embodiment in that the pretreatment liquid ejected from the precoat head 40 has a property of coagulating (solidifying) or precipitating (separating) a component of the ink in addition to the property of lowering the electric resistance value of the sheet P. Thus, in this third embodiment, the application of the pretreatment liquid makes it possible to prevent spreading of the ink and strike-through which is a phenomenon in which the ink landed on a front face of the sheet P penetrate layers of the sheet P to spread or flow out to a back face the sheet P. In addition, the application of the pretreatment liquid makes it possible to improve color saturation of the ink, the quick dry property, an image density, and the like. Thus, in this third embodiment, even where the image recording areas are included in the second areas P2 in S3, the controller 1*p* produces the precoat data such that the pretreatment liquid is applied to all areas of the second areas P2 that include the image recording areas. Accordingly, it is possible to effectively use the pretreatment liquid having not only the property of lowering the electric resistance value of the sheet P but also the property of reacting with the ink to coagulate or precipitate the component of the ink, thereby achieving not only stability of the conveying but also improvement of the image density and the like. In addition, since there is no need to additionally provide a device (e.g., an additional head) for obtaining an effect of the improvement of the image density and the like, it is also possible to simplify the construction of the printer. It is noted that for pigment ink, pretreatment liquid for coagulating pigment color matter is used, and for dye ink, pretreatment liquid for precipitating dye color matter is used.

There will be next explained an ink-jet printer as a fourth embodiment of the present invention.

The printer as the fourth embodiment is different from the printer 1 as the first embodiment in that the controller 1*p* controls the application of the pretreatment liquid in accordance with the electric resistance value of the sheet P. The printer as this fourth embodiment includes, in the casing 1*a*, a detecting device for detecting the electric resistance value of the sheet P. Examples of the detecting device include a humidity sensor, a current measuring device for measuring a value of the current flowing through the sheet P, and the like. For example, where the humidity sensor is used as the detecting device, a table representative of the humidity and the electric resistance value of the sheet P associated with each other is stored in advance into the ROM 102 of the controller 1*p*. Further, where the current measuring device is used as the detecting device, a table representative of the current value and the electric resistance value of the sheet P associated with each other is stored in advance into the ROM 102 of the controller 1*p*. The controller 1*p* refers to the detection signal outputted from the detecting device and the table stored in the ROM 102 to derive or calculate the electric resistance value of the sheet P.

In S3, where the controller 1*p* has judged that the electric resistance value is equal to or larger than a predetermined value as a result of the reference of the electric resistance value derived as described above, the controller 1*p* produces the precoat data. As thus described, the control of the application of the pretreatment liquid in accordance with the electric resistance value of the sheet P makes it possible to effectively restrain the lowering of the electrostatic adsorption force for the sheet P.

Further, in S3, the controller 1*p* adjusts any of (a) an application area to which the pretreatment liquid is to be applied, (b) an amount of the pretreatment liquid to be applied, and (c) the voltage to be applied to the adsorption electrode 50 in accordance with the electric resistance value derived as described above. It is noted that the application area is set to include at least part of the first areas P1. In this fourth embodiment, the adjustment of the application area or the amount of the pretreatment liquid to be applied can improve the electrostatic adsorption force while preventing the excessive use of the pretreatment liquid. In addition, the adjustment of the voltage to be applied to the adsorption electrode 50 can reduce the above-described disadvantages (in cost and safety) which may be caused where an excessively high voltage is applied to the adsorption electrode 50.

While the embodiments of the present invention have been described above, it is to be understood that the invention is not limited to the details of the illustrated embodiments, but may be embodied with various changes and modifications, which may occur to those skilled in the art, without departing from the spirit and scope of the invention.

In the above-described embodiments, the treatment agent is not limited to the liquid and may be a solid material such as a film material. As the treatment agent, there may be used one or both of a pretreatment agent and an after treatment agent. Further, the treatment agent is not particularly limited as long as the treatment agent has a property of lowering an electric resistance value of the recording medium. For example, the treatment agent may be water, glycerin, clear ink (formed by removing color materials from ink components), and the like. Further, the color of the treatment agent is not limited to be colorless and transparent.

The treatment-liquid ejecting portion (the precoat head 40 in the above-described embodiment) is not limited to be disposed at the position facing the platen 9 but may be disposed at a position facing the roller 6, for example.

Further, each of the heads 10 and the precoat head 40 may have an ejection-energy generate portion such as electrostatic actuators and thermal heating elements, instead of the piezoelectric actuators.

As the treatment-agent apply portion, the precoat head 40 having the same construction as the ink-jet heads 10 is used in the above-described embodiment, but the construction of the precoat head 40 is not limited to this construction. For example, in addition to the component configured to eject the treatment liquid like the precoat head 40, the treatment-agent apply portion may be formed by a roller holding the treatment liquid on its roller surface to apply the treatment agent to the recording medium by contact of the roller surface on the recording medium. Examples of the roller include a pressing roller, a thermal transfer roller, and the like.

The treatment agent needs only to be applied to at least part of the first areas P1. For example, the treatment agent may be applied only to the first areas P1 instead of the second areas P2, may be applied to only part of the first areas P1, and may be applied to an entire area of the leading end portion Pt. Further, the treatment agent may be applied not only to the leading end portion Pt of the sheet P but also to a portion of the sheet P other than the leading end portion Pt. The treatment agent needs only to be landed on a front side of the recording medium, and does not need to reach a back side of the recording medium.

The direction in which the first and second electrodes extend is not limited to the conveying direction but may be a direction intersecting the conveying direction. For example, the first and second electrodes may extend in a direction perpendicular to the conveying direction and may be alternately arranged in the conveying direction so as to be spaced at regular intervals. As long as different electric potentials are respectively applied to the first and second electrodes, electric potentials to be applied to the first and second electrodes are limited to the positive and negative electric potentials, but a ground electric potential may be applied to one of the first and second electrodes.

A convey mechanism is not limited to include the sheet-convey belt. For example, the sheet-convey belt may be omitted, and the recording medium may be supported and conveyed on the platen, for example.

An image recording apparatus according to the present invention is not limited to the printer. For example, the present invention may be applied to a facsimile machine, copying machine, and the like. Further, the head according to the present invention may be of any of a line type and a serial type. In addition, the head may eject liquid other than the ink. Further, the head according to the present invention is not limited to the ink-jet type. For example, the head may be of a laser type.

The recording medium is not limited to the sheet P as long as a recordable medium is used. For example, a cloth or the like may be used as the recording medium.

What is claimed is:

1. An image recording apparatus comprising:

an image recording portion configured to eject recording liquid onto a recording medium to record an image on the recording medium;

a treatment-liquid ejecting portion configured to eject treatment liquid onto the recording medium, wherein the treatment liquid is liquid different from the recording liquid and having a property for lowering an electric resistance value of the recording medium;

a conveying mechanism having a support face for supporting the recording medium and configured to convey the recording medium in a conveying direction while supporting the recording medium on the support face;

an attracting mechanism including a first electrode and a second electrode which are arranged so as to be spaced from each other on a plane parallel to the support face and so as to face the recording medium supported on the support face with the support face interposed between the recording medium and the first and second electrodes, the attracting mechanism being configured to electrostatically attract the recording medium to the support face where different electric potential are applied respectively to the first electrode and the second electrode, wherein the first electrode comprises a plurality of electrodes extending in the conveying direction, and the second electrode comprises a plurality of electrodes extending in the conveying direction, and wherein the plurality of electrodes of the first electrode and the plurality of electrodes of the second electrode are alternately arranged one by one in a direction perpendicular to the conveying direction on the plane parallel to the support face; and a controller configured to control the treatment-liquid ejecting portion such that the treatment liquid is ejected onto a plurality of first areas of the recording medium before the image recording portion records the image on the recording medium, wherein each of the plurality of first areas is an area extending from a leading end of the recording medium, and wherein each of the plurality of first areas is overlaid on an area interposed between a corresponding one of the plurality of electrodes of the first electrode and a corresponding one of the plurality of electrodes of the second electrode on the plane parallel to the support face, the corresponding one of the plurality of electrodes of the first electrode and the corresponding one of the plurality of electrode of the second electrode being adjacent to each other, wherein the plurality of first areas are spaced from each other in the direction perpendicular to the conveying direction, and each adjacent two of the plurality of the first areas are arranged with a space therebetween, the space being overlaid on one of the plurality of electrodes of the first electrode and the plurality of electrodes of the second electrode, and the space being an area where the treatment-liquid is not ejected.

2. The image recording apparatus according to claim 1, wherein the first electrode and the second electrode are fixed to a specific position in the image recording apparatus.

3. The image recording apparatus according to claim 2, wherein the conveying mechanism includes:

a convey belt having the support face and operable such that the support face runs in the conveying direction; and a platen configured to support a face of the convey belt opposite to the support face, the first electrode and the second electrode being fixed to the platen.

4. The image recording apparatus according to claim 1, wherein the conveying mechanism includes a convey belt having the support face and operable such that the support face runs in the conveying direction, and wherein the first electrode and the second electrode are provided in the convey belt.

5. The image recording apparatus according to claim 1, wherein the controller is configured to control the treatment-liquid ejecting portion such that the treatment liquid is ejected onto the recording medium uniformly in a direction perpendicular to the conveying direction.

6. The image recording apparatus according to claim 1, wherein a distance in the conveying direction between the leading end of the recording medium and an upstream end of the area in the conveying direction is equal to a specific value.

7. An image recording apparatus comprising:

an image recording portion configured to eject recording liquid onto a recording medium to record an image on the recording medium;

a treatment-liquid ejecting portion configured to eject treatment liquid onto the recording medium, wherein the treatment liquid is liquid different from the recording liquid and having a property for lowering an electric resistance value of the recording medium;

a conveying mechanism having a support face for supporting the recording medium and configured to convey the recording medium in a conveying direction while supporting the recording medium on the support face;

an attracting mechanism including a first electrode and a second electrode which are arranged so as to be spaced from each other on a plane parallel to the support face and so as to face the recording medium supported on the support face with the support face interposed between the recording medium and the first and second electrodes, the attracting mechanism being configured to electrostatically attract the recording medium to the support face where different electric potential are applied respectively to the first electrode and the second electrode, wherein the first electrode comprises a plurality of electrodes extending in the conveying direction, and the second electrode comprises a plurality of electrodes extending in the conveying direction, and wherein the plurality of electrodes of the first electrode and the plurality of electrodes of the second electrode are alternately arranged one by one in a direction perpendicular to the conveying direction on the plane parallel to the support face; and a controller configured to control the treatment-liquid ejecting portion such that the treatment liquid is ejected onto a plurality of areas of the recording medium before the image recording portion records the image on the recording medium, wherein each of the plurality of areas is an area extending from a leading end of the recording medium, and wherein each of the plurality of areas is overlaid on an area straddling a corresponding one of the plurality of electrodes of the first electrode and a corresponding one of the plurality of electrodes of the second electrode on the plane parallel to the support face, the corresponding one of the plurality of electrodes of the first electrode and the corresponding one of the plurality of electrodes of the second electrode being adjacent to each other, wherein the plurality of areas are spaced from each other in the direction perpendicular to the conveying direction, and each adjacent two of the plurality of the areas are arranged with a space therebetween, the space being overlaid on one of the plurality of electrodes of the first electrode and the plurality of electrodes of the second electrode, and the space being an area where the treatment-liquid is not ejected.

8. The image recording apparatus according to claim 1, wherein the controller is configured to control the treatment-liquid ejecting portion such that the treatment liquid is ejected only onto the area of the recording medium near the leading end thereof.

9. The image recording apparatus according to claim 1, wherein the controller is configured to control the treatment-liquid ejecting portion such that the treatment liquid is ejected onto a face of the recording medium except an image recording area thereof on which the image is to be recorded by the image recording portion.

10. The image recording apparatus according to claim 1, wherein the treatment liquid further has a property of coagulating or precipitating a component of the recording liquid by reacting with the recording liquid.

11. The image recording apparatus according to claim 1, wherein the controller is configured, where the electric resistance value of the recording medium is equal to or greater than a predetermined value, to control the treatment-liquid ejecting portion such that the treatment liquid is ejected onto at least the part of the first area.

12. The image recording apparatus according to claim 1, wherein the controller is configured to, according to the electric resistance value, adjust at least one of (a) an ejection area of the recording medium onto which the treatment liquid is ejected, (b) an amount of the treatment liquid to be ejected, and (c) a voltage to be applied to the first electrode and the second electrode.

* * * * *